US009037028B2

(12) United States Patent
Takei

(10) Patent No.: US 9,037,028 B2
(45) Date of Patent: May 19, 2015

(54) CLEANING APPARATUS, PROCESS CARTRIDGE, AND IMAGE FORMING APPARATUS

(71) Applicant: Canon Kabushiki Kaisha, Tokyo (JP)

(72) Inventor: Yuhei Takei, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 106 days.

(21) Appl. No.: 13/710,946

(22) Filed: Dec. 11, 2012

(65) Prior Publication Data

US 2013/0189010 A1 Jul. 25, 2013

(30) Foreign Application Priority Data

Jan. 25, 2012 (JP) ..... 2012-012931

(51) Int. Cl.
*G03G 21/00* (2006.01)

(52) U.S. Cl.
CPC ..... *G03G 21/0029* (2013.01)

(58) Field of Classification Search
CPC ..... G03G 21/0011; G03G 21/0029
USPC ..... 399/350, 351; 267/166, 170, 174, 179
See application file for complete search history.

(56) References Cited

U.S. PATENT DOCUMENTS

| | | | | |
|---|---|---|---|---|
| 6,459,866 | B1 | 10/2002 | Meguro | |
| 7,677,540 | B1 * | 3/2010 | Duval | 267/179 |
| 2002/0025181 | A1 | 2/2002 | Meguro | |
| 2010/0067949 | A1 * | 3/2010 | Watanabe et al. | 399/123 |

FOREIGN PATENT DOCUMENTS

| | | | | |
|---|---|---|---|---|
| CN | 102331702 | A | | 1/2012 |
| JP | 2001-265039 | A | | 9/2001 |
| JP | 2006-259274 | A | | 9/2006 |
| JP | 2006259274 | A | * | 9/2006 |
| JP | 4048682 | B2 | | 2/2008 |
| JP | 2010-217513 | A | | 9/2010 |
| JP | 4585341 | B2 | | 11/2010 |
| JP | 4712946 | B2 | | 6/2011 |

OTHER PUBLICATIONS

Office Action dated Jan. 13, 2015, in Chinese Patent Application No. 201310023397.1.

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

Representative configurations of a cleaning apparatus, a process cartridge and an image forming apparatus according to the present invention includes: a cleaning blade which abuts on a photosensitive drum which bears a toner image, and which removes toner which remains on the photosensitive drum; compression springs which are compressed to pressurize the cleaning blade against the photosensitive drum; and spring attaching portions which regulate phases of compression springs such that positions of the compression springs in a circumferential direction are at predetermined phase positions when the compression springs are attached.

6 Claims, 11 Drawing Sheets

CLEANING APPARATUS, PROCESS CARTRIDGE, AND IMAGE FORMING APPARATUS

BACKGROUND OF THE INVENTION

1. Field of the Invention

The present invention relates to a cleaning apparatus which cleans an image bearing member, a process cartridge having the cleaning apparatus, and an image forming apparatus.

2. Description of the Related Art

Some conventional cleaning apparatuses pressurize cleaning blades against image bearing members using compression springs (U.S. Pat. No. 4,712,946 (U.S. Patent Application Publication No. 2002/0025181 A1) (Patent Document 1) and U.S. Pat. No. 4,048,682 (Patent Document 2)). Using compression springs provides more precise pressures than using tension springs. Further, in case of tension springs, a blade plate end portion generally applies a pressure, and a cleaning blade pressure decreases in a blade center portion.

However, according to Patent Documents 1 and 2, when a plurality of compression springs is used in a longitudinal direction of the cleaning blade, depending on phases of the compression springs in a circumferential direction (positions of the compression springs in the circumferential direction), a pressurizing force of each compression spring varies, and variation in the pressurizing force in the longitudinal direction is produced. This reason is as follows. When biasing forces of springs do not work as in FIG. 11B, end portions of spirals of the springs are likely to abut on a seating plane. By contrast with this, at a position of the phase shifted 180 degrees from the end portion, the springs are likely to float from the seating plane. Hence, pressurizing forces of the springs in the circumferential direction. Therefore, when the phases of the springs are different, a position at which the highest pressurizing forces of the springs are produced in the circumferential direction changes. Meanwhile, phases of the compression springs in a rotation direction indicate at which position in the circumferential direction of the compression springs distal ends of the compression springs (end portions of the screw portions) are positioned with respect to a cleaning blade to be pressurized or a casing frame to which the compression springs are attached.

SUMMARY OF THE INVENTION

According to the present invention, it is desirable to provide a cleaning apparatus, a process cartridge and an image forming apparatus which can prevent pressurizing forces in a longitudinal direction from varying by making phases of compression springs in the circumferential direction uniform (positions of compression springs in the circumferential direction).

To solve the above problem, representative configurations of a cleaning apparatus, a process cartridge and an image forming apparatus according to the present invention includes: a blade which abuts on an image bearing member which bears a toner image, and removes toner which remains on the image bearing member; a pair of spring members which are substantially symmetrically provided with respect to a center position of the blade in a longitudinal direction, and which are compressed to pressurize the blade against the image bearing member; and a regulating portion which regulates phases of the pair of spring members such that the phases of the pair of spring members are a coordinate phase when the pair of spring members are attached.

Further features of the present invention will become apparent from the following description of exemplary embodiments with reference to the attached drawings.

DESCRIPTION OF THE EMBODIMENTS

Figure 1:
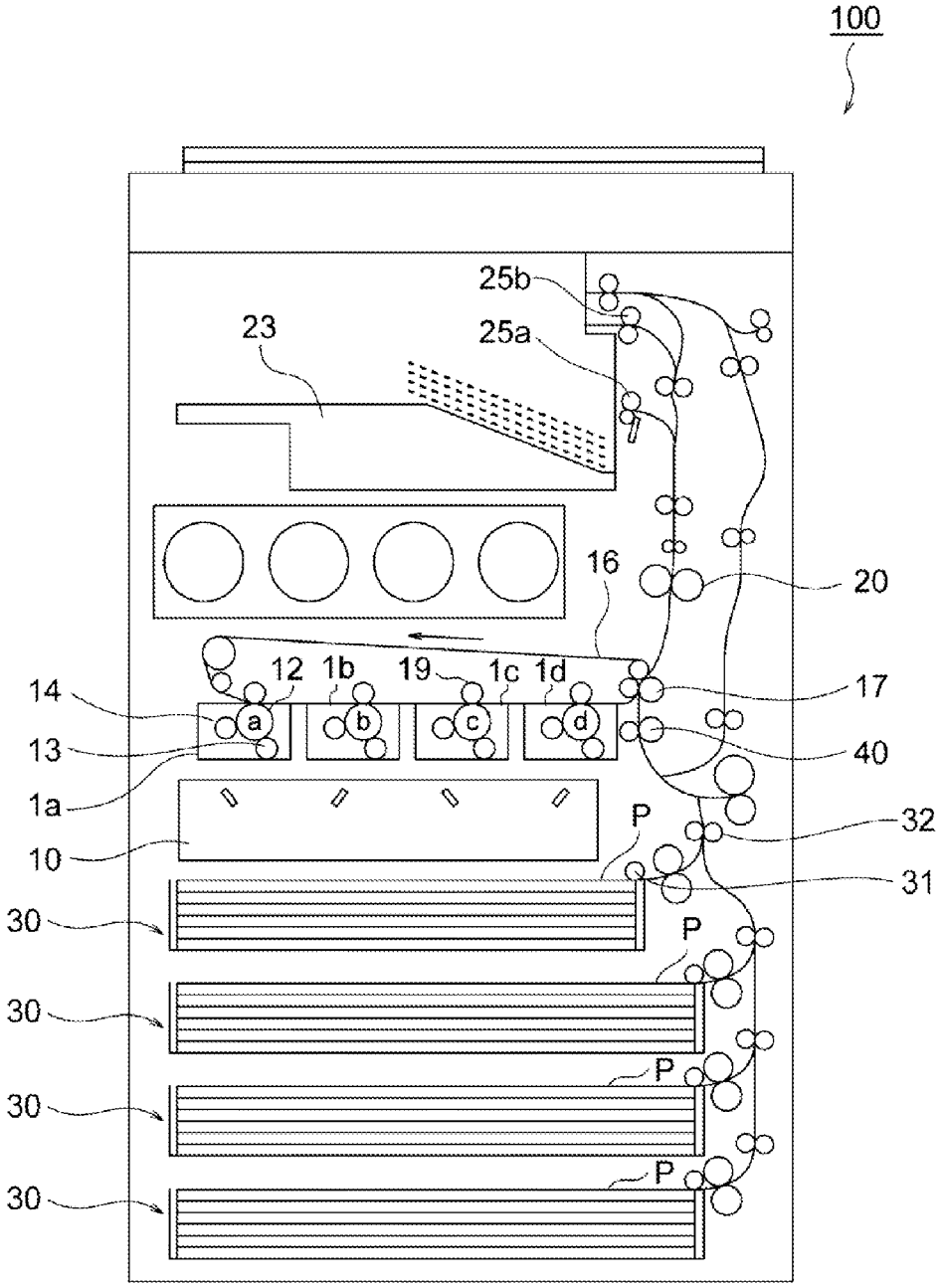
FIG. 1 is a configuration diagram of an image forming apparatus according to the present embodiment.

An embodiment of a cleaning apparatus, a process cartridge and an image forming apparatus according to the present invention will be described with reference to the drawings. FIG. 1 is a configuration diagram of the image forming apparatus according to the present embodiment.

As illustrated in FIG. 1, an image forming apparatus 100 according to the present embodiment has four detachably attachable process cartridges 1*a*, 1*b*, 1*c* and 1*d* which form toner images of each color of yellow, magenta, cyanogen, and black. The process cartridges 1*a* to 1*d* each unitizes a charging roller 13 and a developing sleeve 14.

In each of the process cartridges 1*a* to 1*d*, a photosensitive drum (image bearing member) 12 is charged by the charging roller 13, and is exposed with laser light using an exposure apparatus 10 according to image information to form an electrostatic latent image. The electrostatic latent image formed on the photosensitive drum 12 is developed by a developing sleeve 14 as a toner image of each color using toner of each color, and is overlapped on and primarily transferred to an intermediate transfer belt (intermediate transfer member) 16 by a primary transfer roller 19.

Meanwhile, a sheet P accommodated in cassettes 30 is conveyed to a nipping portion (secondary transfer portion) between the intermediate transfer belt 16 and a secondary transfer roller 17 by a pickup roller 31, a conveying roller 32 and a registration roller 40, and a toner image on the intermediate transfer belt 16 is secondarily transferred thereto.

The sheet P to which the toner image is secondarily transferred is heated and pressurized by a fixing apparatus 20, and is discharged to a discharge tray 23 by discharge rollers 25*a* and 25*b*.

Figure 2A:
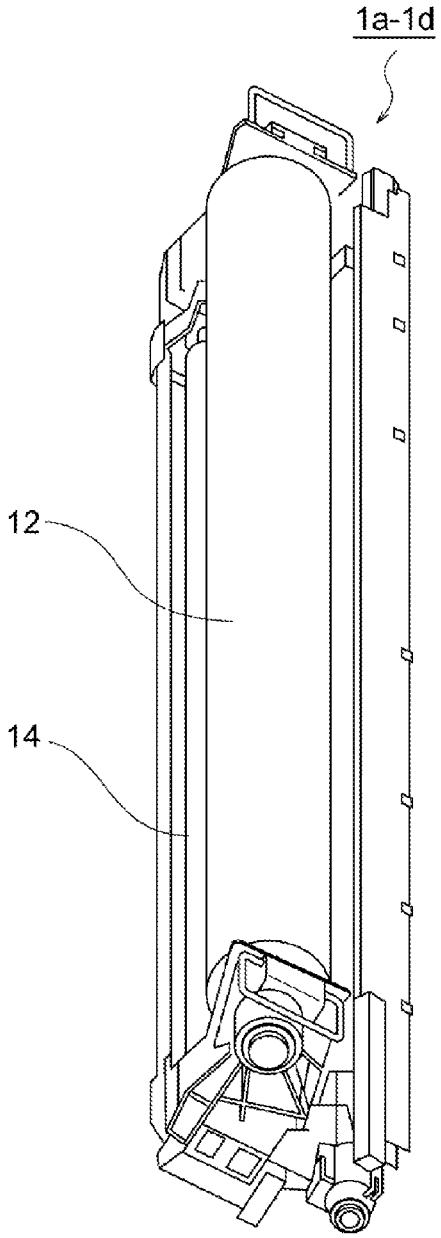
FIGS. 2A and 2B are perspective views of a process cartridge.
Figure 2B:
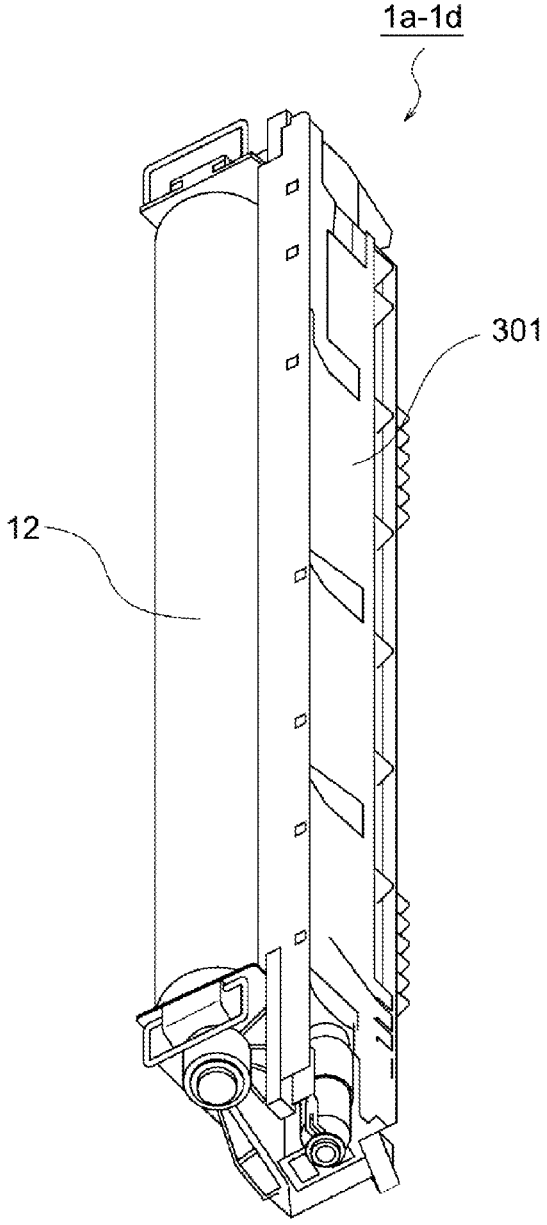
Figure 3A:
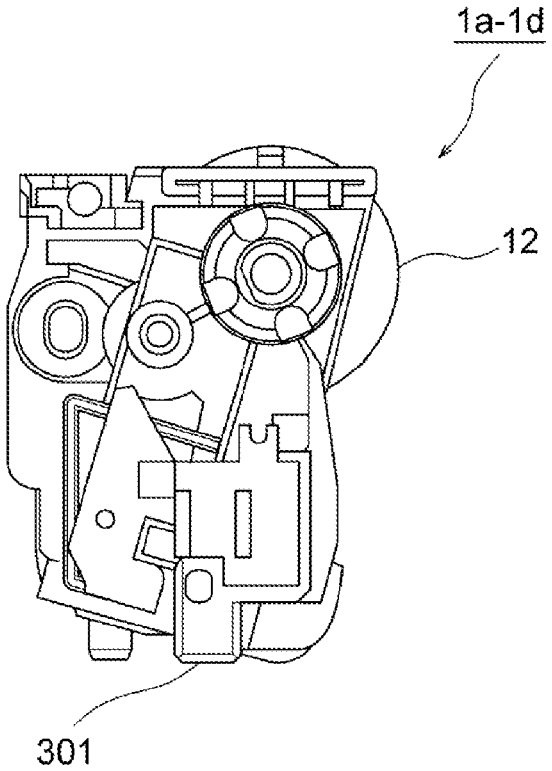
FIGS. 3A and 3B are side views of the process cartridge.
Figure 3B:
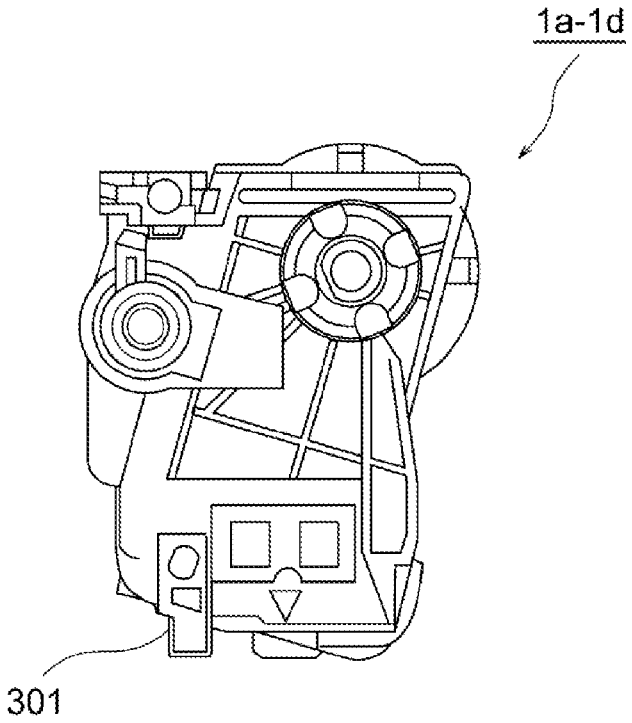
Figure 4:
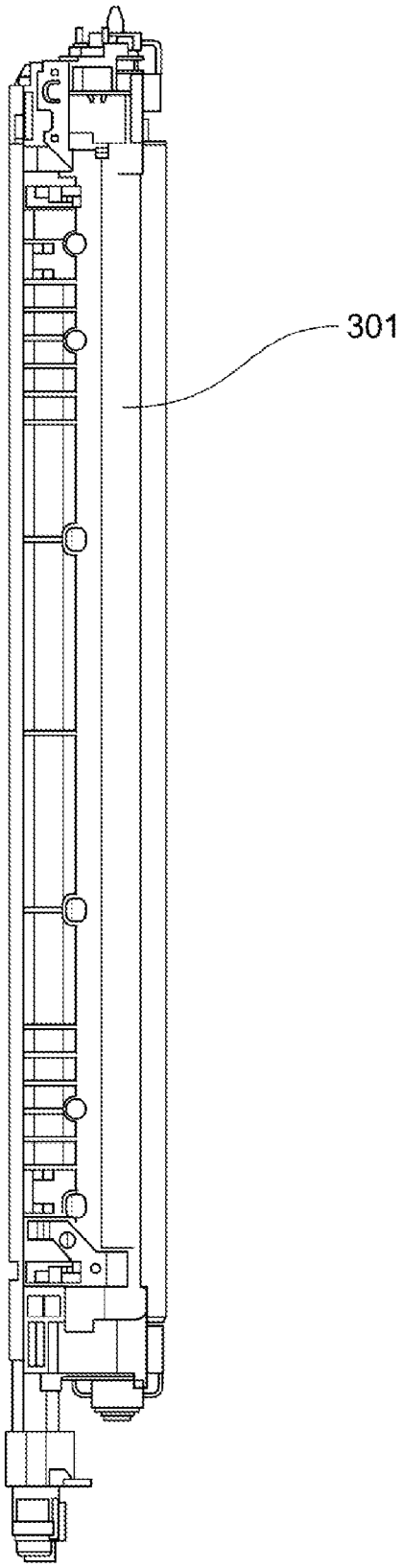
FIG. 4 is a plan view of the process cartridge.
Figure 5:
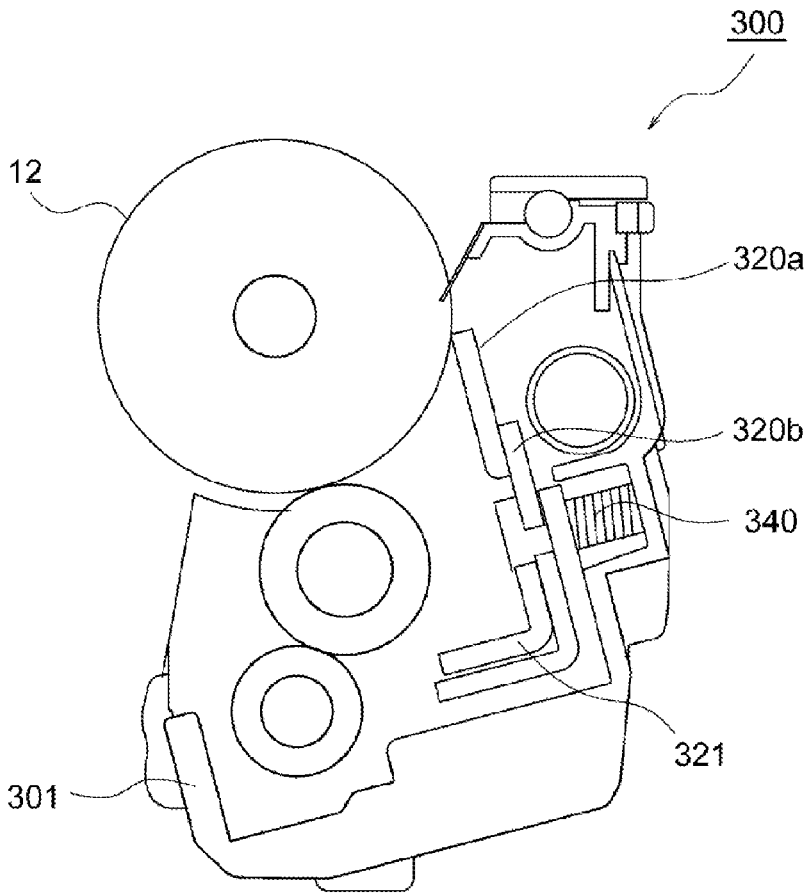
FIG. 5 is a cross-sectional view of a cleaning apparatus.
Figure 6:
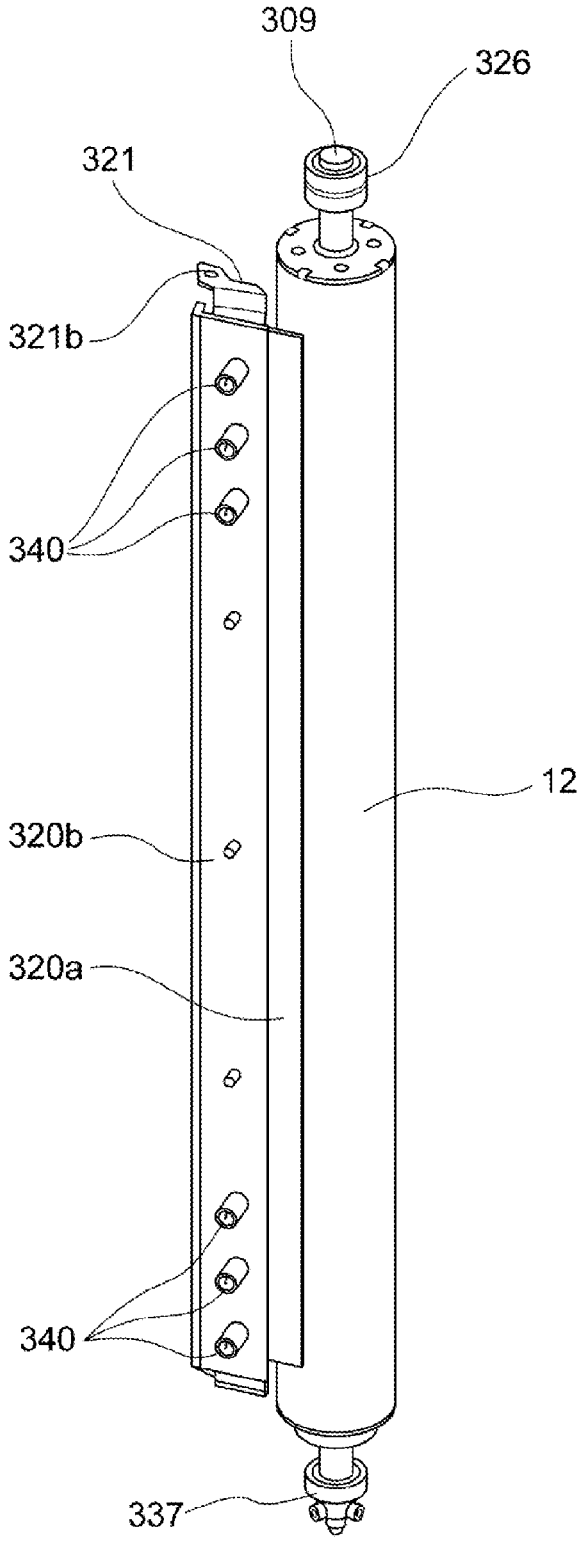
FIG. 6 is a perspective view illustrating that a cleaning blade applies a pressure.
Figure 7:
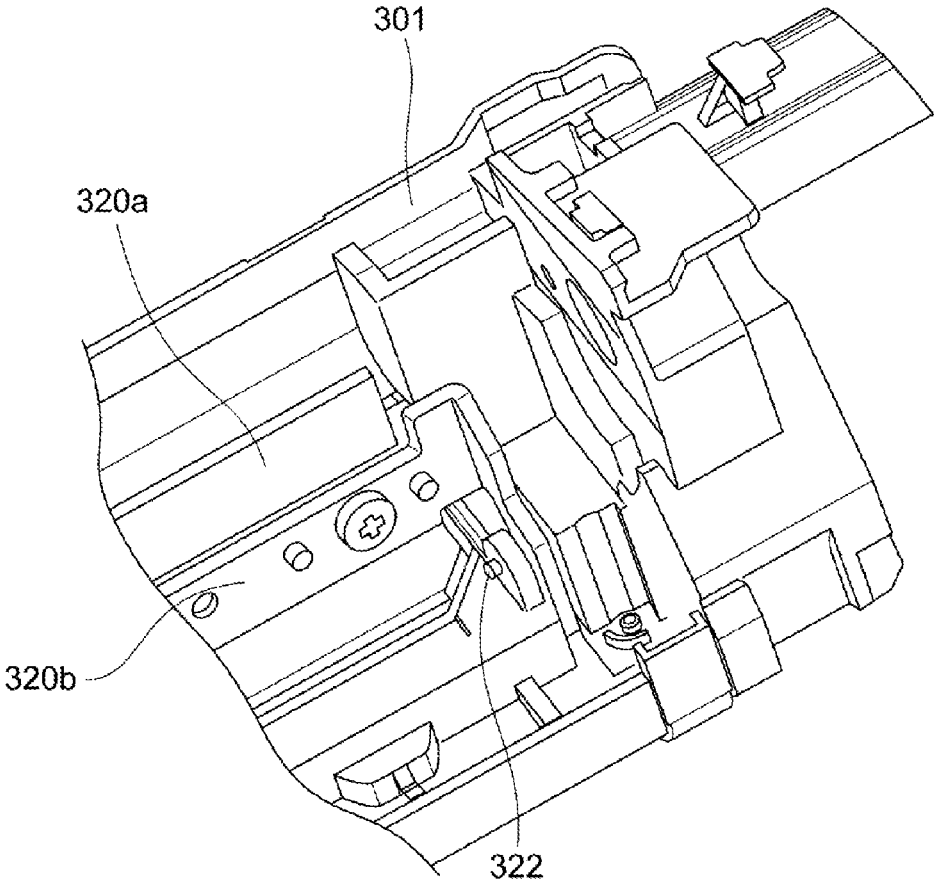
FIG. 7 is a perspective view illustrating that the cleaning blade and a cleaning blade holding plate are attached.

(Process Cartridges 1*a* to 1*d* and Cleaning Apparatus 300) FIGS. 2A and 2B are perspective views of the process cartridges 1*a* to 1*d*. FIGS. 3A and 3B are side views of the process cartridges 1*a* to 1*d*. FIG. 4 is a plan view of the process cartridge 1*a* to 1*d*. FIG. 5 is a cross-sectional view of the cleaning apparatus 300. FIG. 6 is a perspective view illustrating that a cleaning blades applies a pressure. FIG. 7 is a perspective view illustrating that a cleaning blade 320*a* and a cleaning blade holding plate 320*b* are attached.

As illustrated in FIGS. 1 to 7, the process cartridges 1*a* to 1*d* each have a casing frame 301 and the cleaning apparatus 300. The cleaning apparatus 300 has the cleaning blade (blade) 320*a*, a holding plate (holding member) 320*b*, a reinforcing plate 321 and compression springs 340 (spring members). The cleaning apparatus 300 has the cleaning blade 320*a* abut on the photosensitive drum 12 to remove transfer remaining toner remaining on the photosensitive drum 12 after primary transfer.

The casing frame 301 is a resin molding molded using a material made by using about 20% to 30% of a mica compound for polycarbonate and polystyrene. At both ends of the casing frame 301 in the longitudinal direction, penetration holes are provided. Pivotally supporting units 326 and 337 such as bearings or sintered bearings as illustrated in FIG. 6 are arranged in the penetration holes. The drum shaft 309 of the photosensitive drum 12 is inserted in the pivotally supporting units 326 and 337 to precisely pivotally support the photosensitive drum 12 rotatably. The drum shaft 309 is in contact with and is electrically conducted with a drum inner surface through a contact point provided inside the photosensitive drum 12, and is connected to an earth.

As illustrated in FIGS. 5 and 6, the cleaning blade 320*a* is formed in a plate shape using urethane rubber, and is adhered to and integrated with the holding plate 320*b*. The holding plate 320*b* is, for example, a Zin kote steel plate formed by press-working a steel plate.

The reinforcing plate 321 is fastened to the holding plate 320*b* by screws. The reinforcing plate 321 prevents the holding plate 320*b* and the cleaning blade 320*a* from bending. Side surfaces of both end portions of the reinforcing plate 321 in the longitudinal direction are bent, and swing holes 321*b* are provided in these bent side surfaces.

As illustrated in FIG. 7, the swing shafts 322 penetrate swing holes of the casing frame 301 and swing holes 321*b* of the reinforcing plate 321. By this means, the cleaning blade 320*a* and the holding plate 320*b* are swingably attached to the casing frame 301.

As illustrated in FIGS. 5 and 6, the reinforcing plate 321, the holding plate 320*b* and the cleaning blade 320*a* swing about the swing shaft 322 of the center of swing by means of biasing forces of the compressed compression springs 340. By this means, the cleaning blade 320*a* is biased toward the photosensitive drum 18 at a desired pressurizing force. The compression springs 340 are held between the casing frame 301 and the holding plate 320*b*.

Figure 11A:
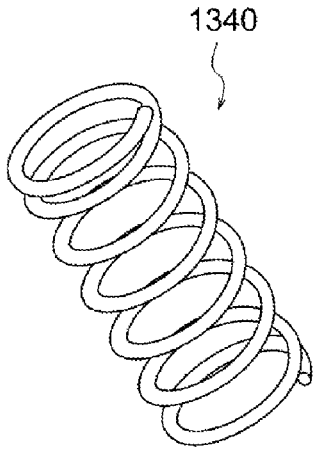
FIG. 11A PRIOR ART
FIG. 11A is a perspective view illustrating a conventional compression spring.
Figure 11B:
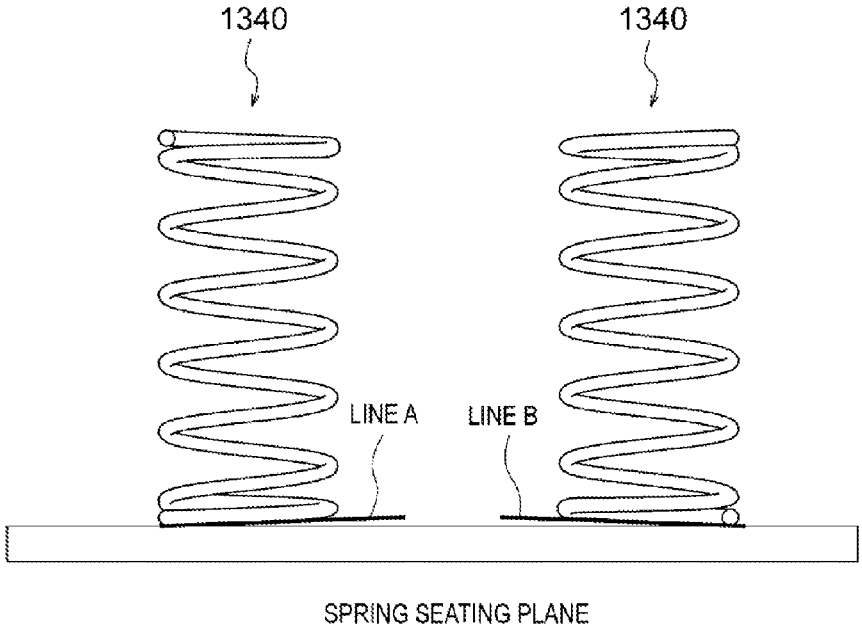
FIG. 11B PRIOR ART
FIG. 11B is a view describing a problem of a cleaning apparatus which uses conventional compression springs.

(Conventional Cleaning Apparatus) FIG. 11A is a perspective view illustrating a conventional compression spring. FIG. 11B is a view describing a problem of a cleaning apparatus which uses conventional compression springs.

In a swing type cleaning apparatus using conventional compression springs, a plurality of compression springs 1340 as illustrated in FIG. 11A is provided in the longitudinal direction of the photosensitive drum, and a biasing force of a plurality of these compression springs 1340 pressurizes a cleaning blade against a photosensitive drum. Portions which are pressurized by the compression springs 1340 are generally both ends and a center portion in the longitudinal direction.

The compression spring 1340 is formed by one needle member having a spiral shape. Hence, when the biasing forces of the springs do not work as illustrated in FIG. 11B, only a distal end side of the needle member abuts on a spring seating plane at both end portions of the spring, and is spaced apart from the spring seating plate toward the other end side according to the angle of the spiral shape.

Hence, depending on the phase of the compression spring 1340 in the rotation direction (the position of the compression spring in the circumferential direction), the angle of a tilt of the compression spring 1340 in the vertical direction changes similar to a line A or a line B, and variation in a pressurizing force of pressurizing the cleaning blade in the longitudinal direction is produced. Meanwhile, the phase of the compression spring in the rotation direction indicates at which position (angle) in the circumferential direction of the compression spring 340 the distal end of the compression spring 340 is positioned with respect to the cleaning blade 320*a* to be pressurized or the casing frame 301 to which compression springs are attached.

Figure 8A:
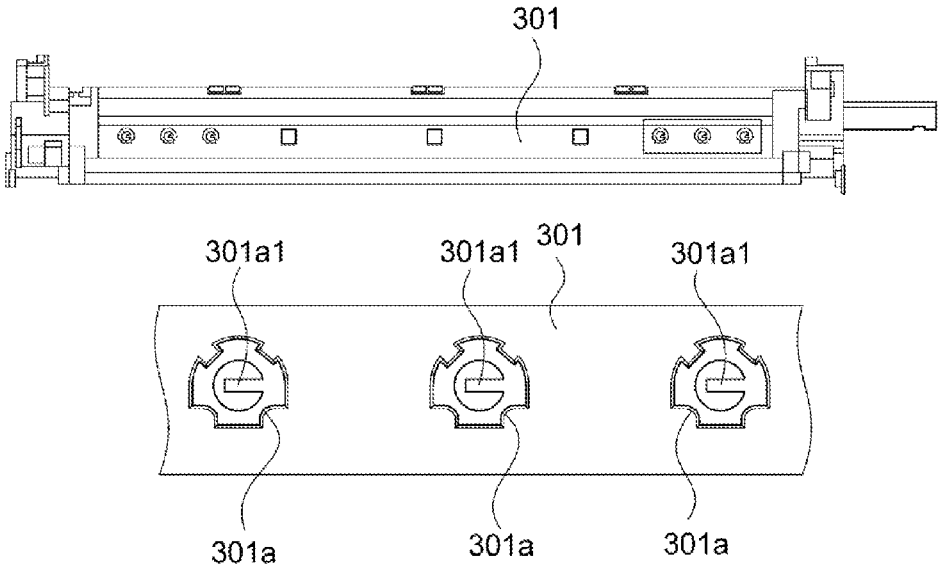
FIG. 8A is a view illustrating spring attaching portions of a casing frame according to the present embodiment.
Figure 8B:
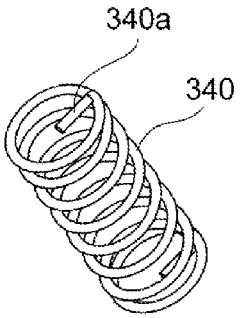
FIG. 8B is a perspective view illustrating a compression spring according to the present embodiment.
Figure 8C:
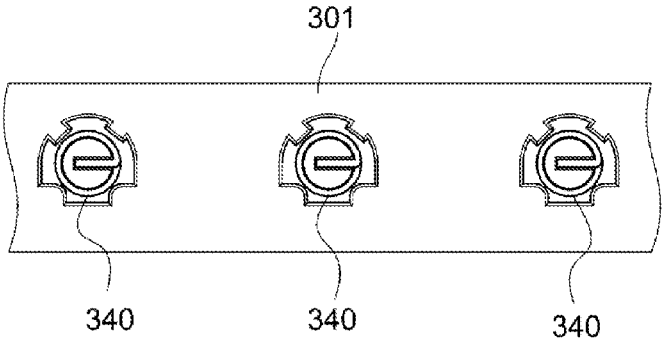
FIG. 8C is a view illustrating a state where the compression springs according to the present embodiment are attached to the spring attaching portions of the casing frame.

(Cleaning Apparatus 300 according to the Present Embodiment) FIG. 8A is a view illustrating spring attaching portions 301*a* of the casing frame 301 according to the present embodiment. FIG. 8B is a perspective view illustrating the compression spring 340 according to the present embodiment. FIG. 8C is a view illustrating a state where the compression springs 340 according to the present embodiment are attached to the spring attaching portions 301*a* of the casing frame 301.

As illustrated in FIG. 8A, the casing frame 301 has the spring attaching portions (regulating portions) 301*a* to which the compression springs 340 are attached. As illustrated in FIG. 8B, the compression spring 340 is formed by one needle member having a spiral shape, and one end forms an engaging portion 340*a* bent toward the center. When the compression spring 340 is at a predetermined phase, the engaging portion 340*a* of the compression spring is inserted and attached to the groove portion 301*a*1 (regulating portion) provided in the spring attaching portion 301*a*.

That is, the groove portion 301*a*1 is formed to allow the compression spring 340 to be inserted to an attaching position when the compression spring 340 is at a predetermined phase position. By this means, the spring attaching portion 301*a* regulates the phase of the compression spring 340 such that the position of the compression spring 340 in the circumferential direction when the compression spring 340 is attached is at a predetermined phase position.

All spring attaching portions 301*a* have groove shapes formed orienting toward the same direction, and, when the stick-shaped engaging portions 340*a* engage in these groove portions 301*a*1, tilts of all compression springs 340 in the vertical direction are in the same direction. Meanwhile, at the end surface of the compression spring 340 on the opposite side, the number of turns of the spring is determined according to a spring pressure. Hence, by determining the phase of the seating plane of the compression spring 340 as described above, the phase of the opposite side end surface of the compression spring 340 which pressurizes the cleaning blade 320*a* is also determined. By this means, pressurizing forces of all compression springs 340 against the cleaning blade 320*a* becomes the same, so that it is possible to prevent the pressurizing forces in the longitudinal direction from varying. By this means, it is possible to perform stable cleaning.

Figure 9A:
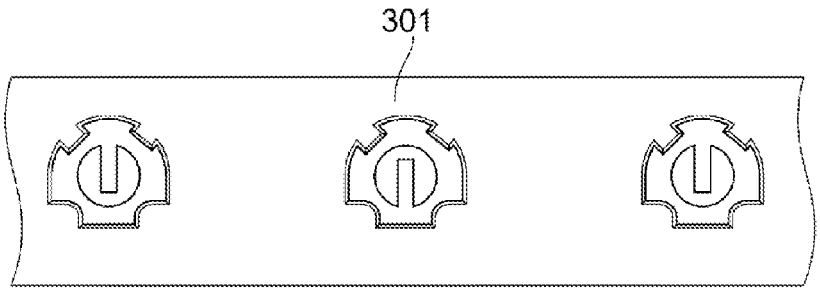
FIGS. 9A and 9B are views illustrating another configuration of the spring attaching portions of the casing frame.

In addition, a configuration of determining the phases of the compression springs 340 is not limited to the above configuration. For example, all phases of the compression springs 340 do not need to be the coordinate phase. FIG. 9A illustrates a configuration of pressurizing one end side of a cleaning blade at three points. A configuration may be employed where, as illustrated in FIG. 9A, phases of both end portions in the longitudinal direction are the coordinate phase, and the phase in the center of the longitudinal direction is the opposite phase. Meanwhile, in this case, the phase of the cleaning blade on the other end side needs to have a relationship of a coordinate phase with the corresponding springs on one end side. That is, the phases of each pair of springs arranged at both left and right ends have the relationship of a coordinate phase with respect to the center of the cleaning blade in the longitudinal direction.

That is, a desired pressurizing force can only be applied to the cleaning blade 320*a* by fixing the angles of the compression springs 340 in the circumferential direction at predetermined angles. By this means, it is possible to have the cleaning blade 320*a* abut on the photosensitive drum 12 at a desired pressurizing force in the longitudinal direction, prevent the pressurizing forces in the longitudinal direction from varying and perform stable cleaning.

Further, desirably, the compression springs 340 are not pressed fit in the spring attaching portions 301*a*, and are positioned by engaging with the spring attaching portions 301*a* with predetermined gaps. By providing the gaps between the compression springs 340 and the spring attaching portions 301*a*, the spring attaching portions 301*a* can fix the compression springs 340 without preventing the compression springs 340 from stretching. Hence, pressurizing forces are not produced at engaging portions similar to cases where the compression springs 340 are pressed fit in and fixed to the spring attaching portions 301*a*. Consequently, it is possible to provide desired pressurizing forces and prevent the pressurizing forces from fluctuating.

Figure 9B:
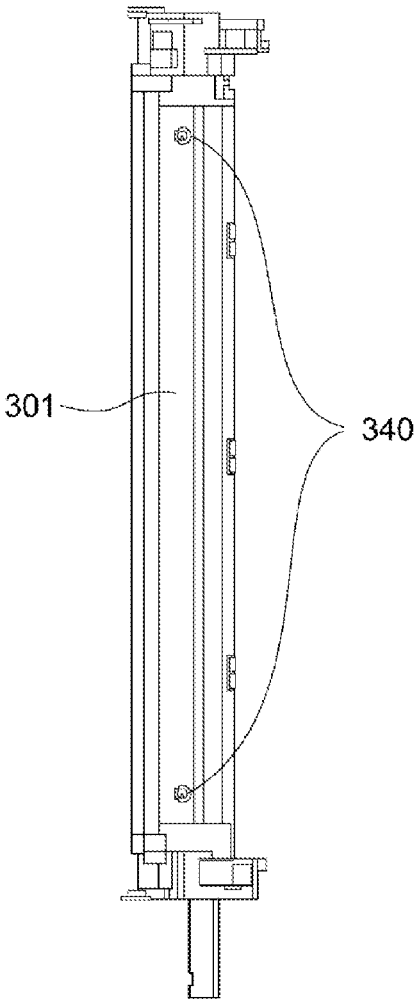

Further, although the six compression springs 340 are used with the present embodiment, a configuration may be employed where, as illustrated in FIG. 9B, two compression springs 340 are used at both end portions in the longitudinal direction.

Figure 10:
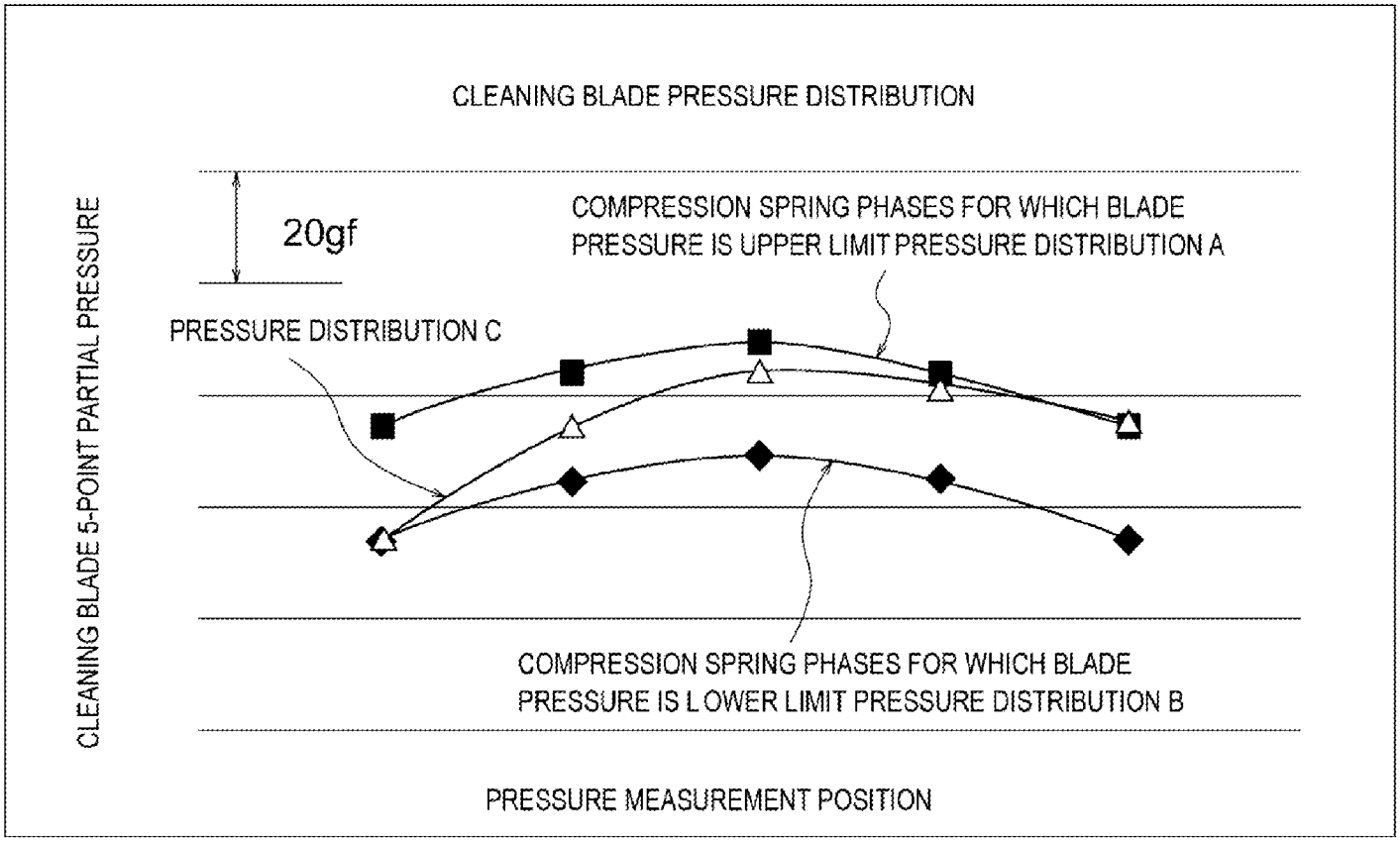
FIG. 10 is a view illustrating a pressurizing force of the cleaning force against the image bearing member.

FIG. 10 is a pressure distribution diagram of a pressurizing force of the cleaning blade 320*a* against the photosensitive drum 12 at five divided positions of the cleaning blade 320*a* in the longitudinal direction. As illustrated in FIG. 10, when the compression springs 340 can have any phases, the pressurizing force of the cleaning blade 320*a* against the photosensitive drum 12 varies between a pressure distribution A and a pressure distribution B. More specifically, the pressure distribution A and the pressure distribution B are provided just when a phase difference is 180 degrees. A pressure distribution C is provided when phases are different in the longitudinal direction. According to these pressure distributions, pressure distributions vary between devices when devices are different. By contrast with this, when the phases of the compression springs 340 are made uniform in the same direction per device as in the present embodiment, the pressurizing force of the cleaning blade 320*a* against the photosensitive drum 12 provides one of the pressure distribution A and the pressure distribution B, so that it is possible to prevent variation (device individual difference).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-012931, filed Jan. 25, 2012, which is hereby incorporated by reference herein in its entirety.

What is claimed is:

1. A cleaning apparatus comprising:

a blade which abuts on an image bearing member which bears a toner image, and removes toner which remains on the image bearing member;

a first spiral spring which is disposed at one side portion of the blade in a longitudinal direction and is compressed to press the blade toward the image bearing member;

a second spiral spring which is disposed symmetrically from the first spiral spring with respect to the center of the blade in the longitudinal direction and is compressed to press the blade toward the image bearing member;

a first attachment portion which allows the first spiral spring to attach to an apparatus main body when the first spiral spring is positioned at a predetermined rotational orientation, and does not allow the first spiral spring to attach to the apparatus main body when the first spiral spring is positioned at a rotational orientation other than the predetermined rotational orientation; and a second attachment portion which allows the second spiral spring to attach to the apparatus main body when the second spiral spring is positioned at the predetermined rotational orientation, and does not allow the second spiral spring to attach to the apparatus main body when the second spiral spring is positioned at a rotational orientation other than the predetermined rotational orientation.

2. A process cartridge comprising:

a developing apparatus which develops an electrostatic latent image formed on the image bearing member as a toner image using toner;

a transfer apparatus which transfers the toner image developed by the developing apparatus to a sheet or an intermediate transfer member; and the cleaning apparatus according to claim 1 which cleans the image bearing member after the transfer apparatus transfers the toner image.

3. An image forming apparatus comprising the process cartridge according to claim 2 which is detachably attachable.

4. The cleaning apparatus according to claim 1, wherein the first spiral spring and the second spiral spring include screw portions which are spiraled, and engaging portions which are extended toward centers of spirals of the screw portions and determine the rotational orientations of the first spiral spring and the second spiral spring.

5. The cleaning apparatus according to claim 1, wherein the first spiral spring and the second spiral spring are respectively positioned by engaging with the first attachment portion and the second attachment portion with a predetermined gap.

6. The cleaning apparatus according to claim 1, further comprising:

a third spiral spring which is disposed at one side portion of the blade in the longitudinal direction and is compressed to press the blade toward the image bearing member;

a fourth spiral spring which is disposed symmetrically from the third spiral spring with respect to the center of the blade in the longitudinal direction and is compressed to press the blade toward the image bearing member;

a third attachment portion which allows the third spiral spring to attach to an apparatus main body when the third spiral spring is positioned at a predetermined rotational orientation, and does not allow the third spiral spring to attach to the apparatus main body when the third spiral spring is positioned at a rotational orientation other than the predetermined rotational orientation; and a fourth attachment portion which allows the fourth spiral spring to attach to the apparatus main body when the fourth spiral spring is positioned at the predetermined rotational orientation, and does not allow the fourth spiral spring to attach to the apparatus main body when the fourth spiral spring is positioned at a rotational orientation other than the predetermined rotational orientation.

* * * * *